US006835128B1

(12) United States Patent
Olson

(10) Patent No.: US 6,835,128 B1
(45) Date of Patent: Dec. 28, 2004

(54) CEILING MOUNTED AIR FILTERING AND DISTRIBUTION APPARATUS OPERATED INDEPENDENTLY OF ANY HVAC SYSTEM

(76) Inventor: Mark B. Olson, 168 Robin Ct., Plainfield, IL (US) 60544

( * ) Notice: Subject to any disclaimer, the term of this patent is extended or adjusted under 35 U.S.C. 154(b) by 104 days.

(21) Appl. No.: 09/737,910

(22) Filed: Dec. 15, 2000

(51) Int. Cl.[7] ..... F24F 7/06
(52) U.S. Cl. ..... 454/232; 454/251; 454/158
(58) Field of Search ..... 454/232, 251, 454/158; 55/385.2, 467; 415/215.1

(56) References Cited

U.S. PATENT DOCUMENTS

| | | | | | |
|---|---|---|---|---|---|
| 4,108,051 | A | | 8/1978 | Eakes | |
| 4,726,824 | A | | 2/1988 | Staten | |
| 4,762,053 | A | * | 8/1988 | Wolfert | 454/260 |
| 4,905,578 | A | | 3/1990 | Curtis | |
| 4,913,621 | A | * | 4/1990 | Reither | 415/215.1 |
| 4,955,997 | A | * | 9/1990 | Robertson, III | 96/138 |
| 5,151,063 | A | * | 9/1992 | Tanaka et al. | 454/258 |
| 5,332,409 | A | * | 7/1994 | Dralle | 55/484 |
| 5,417,729 | A | * | 5/1995 | Greenleaf, Sr. | 55/350.1 |
| 5,487,768 | A | | 1/1996 | Zytka | |
| 5,733,348 | A | | 3/1998 | Skarsten | |
| 6,164,457 | A | * | 12/2000 | Schlor | 210/455 |
| 6,328,776 | B1 | * | 12/2001 | Shanks et al. | 55/385.2 |

* cited by examiner

*Primary Examiner*—Jiping Lu
(74) *Attorney, Agent, or Firm*—Patnaude & Videbeck

(57) ABSTRACT

A modular direct flow clean air delivery apparatus is disclosed that is particularly adapted for use in restaurants, banquet halls, meeting rooms, offices etc., where cigarette smoke and other pollutants need to be efficiently removed from the air in the room. The filtering and air moving apparatus may be mounted above a false ceiling in a whole room, or any part of a room, and includes remotely located air intakes and supplies, high capacity minipleat V-bank filters, and backwards curved impeller blowers mounted in the duct work between the intakes, supplies and the filtering apparatus for utmost efficiency and uncompromised air movement in a room. The modular apparatus may also be suspended from high ceilings with the use of rigid ductwork.

16 Claims, 6 Drawing Sheets

CEILING MOUNTED AIR FILTERING AND DISTRIBUTION APPARATUS OPERATED INDEPENDENTLY OF ANY HVAC SYSTEM

This invention relates generally to a modular air filtering apparatus, and more particularly, to stand alone air filtering apparatus for use in restaurants, banquet halls, meeting rooms, offices and the like that pick up, filter and exhaust air at remote locations across the false ceiling in a room.

BACKGROUND OF THE DISCLOSURE

Heretofore, several methods have been used to filter the air in meeting rooms, banquet halls, restaurants, offices and the like. One comprehensive apparatus for cleaning the air is to install filters, electrostatic precipitators, or the like in line in the duct work of an existing, heating, ventilating and air conditioning system shortly after the air leaves the furnace portion of the system. While this filtering apparatus treats all of the air going through the entire HVAC system, if a whole room in one building like a restaurant, only needs a portion of the total serviced by the heating, ventilating and air conditioning system, treated by filtration, that apparatus may be an expensive over-kill.

Another apparatus for filtering air in a room is a self-contained air filtering apparatus such as shown in U.S. Pat. No. 5,733,348. This patent discloses a filter, blower and air inlet and outlet all in one rectangular package suitable for positioning in a false ceiling in a room. Such an apparatus may prove to be inefficient in cleaning air at locations remote from the apparatus. In order to somewhat correct that problem, multiple self-contained units may have to be used in a single room, thereby driving up the cost and the expense of running and maintaining multiple units. Other apparatus, such as found in U.S. Pat. No. 4,905,578, may be utilized in clean rooms or the like. Other filtering apparatus may have a "room" that is made smaller and positioned within the ventilating apparatus such as shown in U.S. Pat. 4,108,051. This type of mechanism is inconvenient for use in large meeting rooms, restaurants, offices and the like. Another apparatus similarly used in a controlled material handling space is described in U.S. Pat. No. 5,487,768. This system has the same limitations with respect to transferring the use of a controlled space to the use of a room utilized such as a restaurant, banquet hall or the like. Another U.S. Pat. No. 4,726,824 discloses an air purification system suitable for use in a room. However, that system has ductwork not only in the ceiling of the room but outside the walls of the room, and would need to be implemented during the actual construction of the building or room. Such a system would be too expensive and require too much modification to be retrofitted into a room that already exists.

A need has developed for an improved modular air filtration system that may be expanded or contracted physically to be mounted on or above the false ceiling of a restaurant, banquet room, meeting room, office or the like to provide for filtration of the air in a room, or a specific portion of a room.

It is, therefore, an object of the present invention, generally stated, to provide a new and improved air filtration apparatus for use in restaurants, banquet halls, meeting rooms, offices and the like. It is a further object of the invention to provide a modular air filtration apparatus that exists separately from any heating and ventilating and air conditioning system therein and that may be mounted on or above the false ceiling of a room.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

FIG. 6 is a diagrammatic view of a clean air delivery apparatus having single supply single return flow pattern utilizing a filter box in between;

DETAILED DESCRIPTION OF THE PREFERRED EMBODIMENTS

Figure 1A:
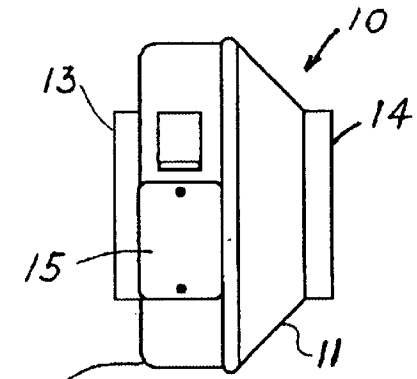
FIG. 1*a* is a side elevational view of the housing for the fan shown in FIG. 1.
Figure 1:
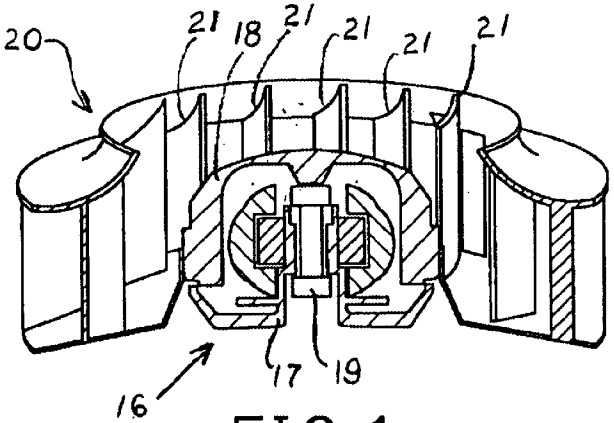
FIG. 1 is a cross-sectional view of the single inlet backward curved centrifugal fan, constructed in accordance with the present invention.

Referring to FIGS. 1 and 1*a*, the stand alone modular clean air filtering and delivery apparatus of the present invention moves air through the entire apparatus by means of a fan unit, generally indicated at 10 including an external housing or baffle 11–12 having a circular outlet 13 and a circular inlet 14 in connection therewith. Control circuitry for the fan motor is positioned in the electrical box 15.

Referring to FIG. 1, the motor for the fan is an external rotor motor, generally indicated at 16, and it includes a stator with windings 17, and a rotor 18 which rotates on a shaft 19. In this embodiment, the rotor 18 has mounted externally thereon a single inlet backward curved centrifugal fan, generally indicated at 20. The fan 20 includes a plurality of backwardly curved blades 21—21 that direct the air through the fan in a direction parallel to the shaft 19. Generally, in the preferred embodiment, the backward curved impellers are made with either plastic impellers on a disk of galvanized sheet steel, or are made entirely of galvanized sheet steel. The impellers are press fitted directly onto the rotor of the external rotor motor 18. Maximum power consumption of backward curved impellers is reached in the low back pressure area as the back pressure increases. The use of backward curved impellers provides more efficient and less costly movement of air through the clean air delivery apparatus constructed in accordance with the present invention than that provided by prior known fans. The use of the single inlet backward curved centrifugal fan 20 in the fan unit 10 provides a more efficient enclosed fan unit which is constructed for air-tight use with flexible round duct work or spiral round ductwork (to be discussed in more detail below) than that heretofore known, which is an important aspect of the stand alone clean air delivery system of the present invention.

Figure 2A:
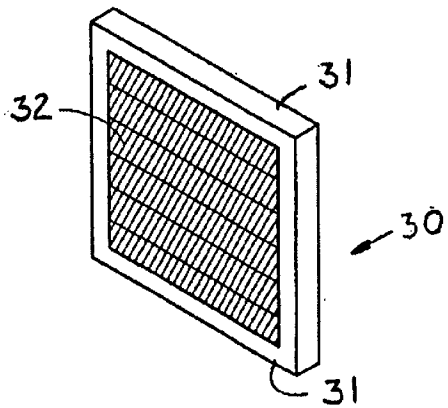
FIG. 2*a* is a perspective view of an activated carbon odor filter cartridge.
Figure 2:
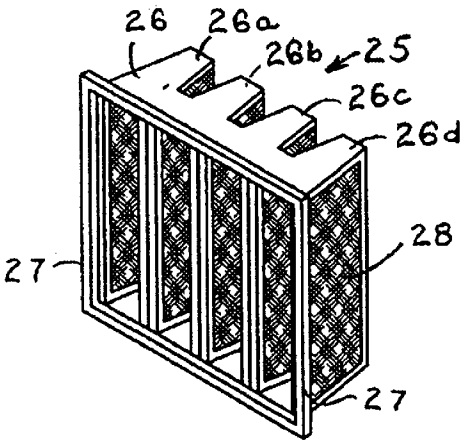
FIG. 2 is a perspective view of a mini-pleat V-bank particle filter cartridge constructed in accordance with the present invention.

Referring to FIG. 2, a mini-pleat particle filter core or cartridge, generally indicated at 25, and sold under the trademark V-BANK, by Filtration Group of Joliet, Ill., includes a frame defined by end panels 26—26 (one shown) and connecting frame posts 27—27. These filters are offered in two sizes, 24"×24"×12" and 12"×24"×12". The frame posts are typically 1"×11"×12" the importance of which will be discussed in further detail below. The filtering media 28 is wound from one of the frame posts 27 through the ends of the various fingers 26*a*, 26*b*, 26*c*, 26*d* respectively, between end panels 26—26 in a V-shape or a pleat type arrangement and may also be layered with an outside portion and one or more inside media portions to increase the square footage of filtering media that may be enclosed in a single mini-pleat filter cartridge 25. In operation, a single filter cartridge sized 2 feet by 2 feet by 1 foot may include up to 193 square feet of filtering media, and a cartridge sized 1 foot by 2 feet by 1 foot may include up to 97 square feet of filtering media. The extended media surface provides a very low resistance to air flow. A low pressure drop of air running through the filter cartridge results in lower energy costs and longer filter life. A minimum standard for such an air cleaning system would by 95% ASHRAE or better. The rigid frame and stable mini-pleat filter cartridge design not only distributes air substantially completely across the filter but also allows for a large variation in air flow and pressure drop without affecting the filter performance and efficiency. The performance is also not affected by repeated fan shut downs or changes in air flow velocities. Such a filter is rated a continuous air flow rates of up to 3,000 cubic feet per minute.

Referring to FIG. 2*a*, an activated carbon filter panel, indicated generally at 30, includes a thin, generally square frame 31 of 12×24×1, having a plurality of activated carbon particles 32 sandwiched between the one inch frame rails 31—31 and maintained therein by a mesh covering (not shown).

Figure 3A:
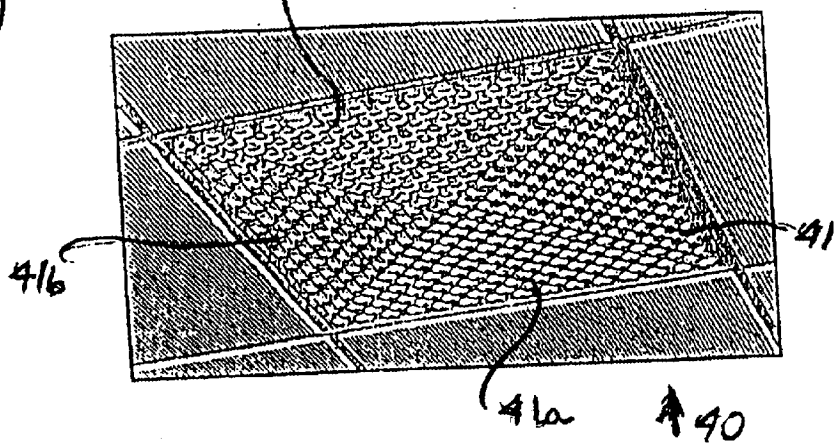
FIG. 3*a* is a perspective view of a second embodiment of an air supply/diffuser mounted on a false ceiling.
Figure 3:
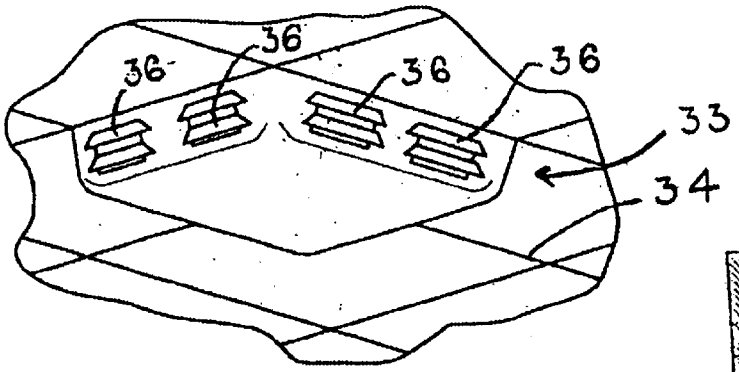
FIG. 3 is a perspective view of a first embodiment of an air supply/diffuser mounted on a false ceiling.

Referring to FIG. 3, a first embodiment of a ceiling mounted directional air supply diffuser, generally indicated at 33 is a square 2' by 2' metal structure that mounts on a false ceiling framework 34, protrudes below the false ceiling frame and includes multi-directional dampers/louvers 36—36 that provide the air supply with eight-way adjustable dampers that direct the air both horizontally and vertically to insure proper air circulation. The adjustable louvers 36–34 provide for targeting the airflow around obstructions, if necessary, in desired directions and can control the air-volume by closing the louvers, if necessary. This embodiment is intended for better air control when used in rooms with higher ceilings.

Figure 3B:
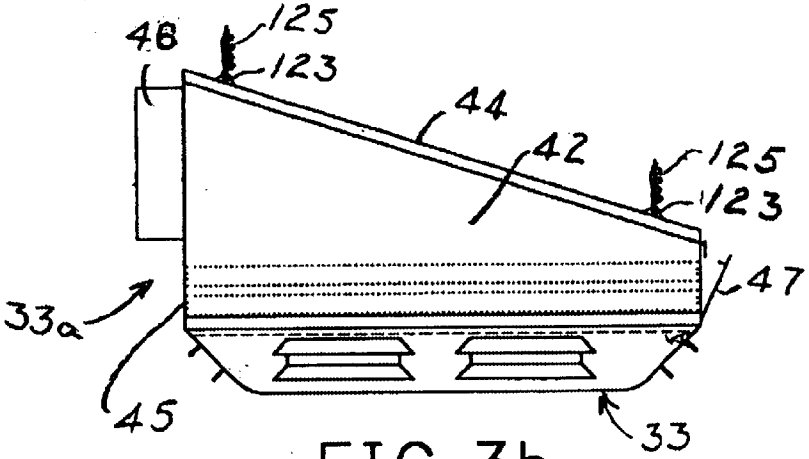
FIG. 3*b* is a side elevational view of the air supply/diffuser shown in FIG. 3.
Figures 4, 4A:
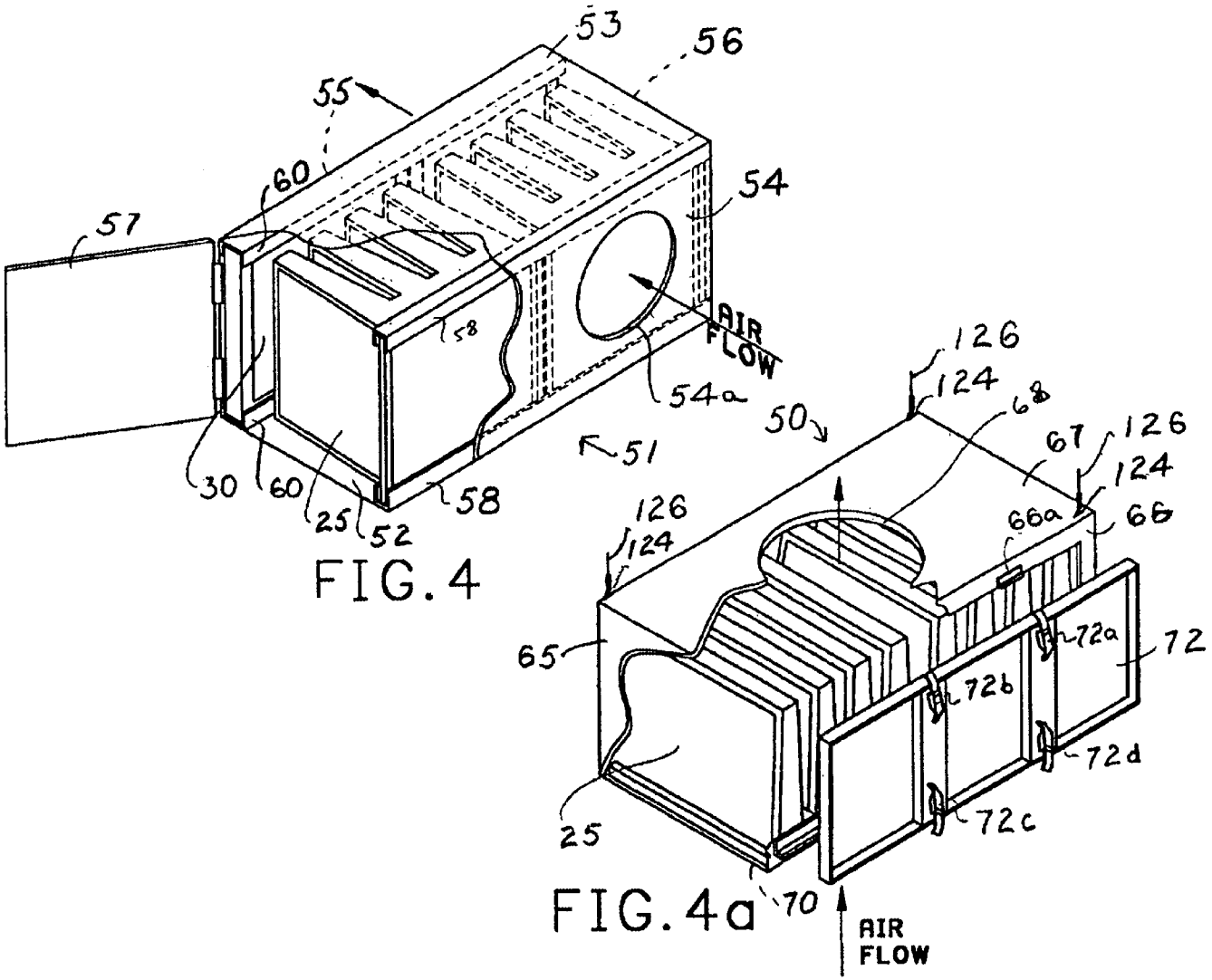
FIG. 4 is a perspective view of an air filter box utilized in a "slimline" unit showing particle and odor filters mounted therein.
FIG. 4*a* is a perspective view of a combined air filter/return unit mountable on a false ceiling gridwork.

Referring to FIG. 3*a*, a second embodiment of an air supply diffuser, generally indicated at 40, includes a flat bottom sheet 41 that mounts on a false ceiling grid work, and includes in this embodiment, permanent air directional louvers 41 41*a*, 41*b* and 41*c* that direct air in four differing directions. It should be noted that alternative bottom sheets (not shown) may have permanent louvers positioned for one-way flow, two-way, three-way, five-way, 6-way and 8-way flow, depending on a user's desires. FIG. 3*b* shows the plenum which can be permanently attached to the diffuser of FIG. 3 or 3*a* (FIG. 3*b* shows attachment to the diffuser in 3) that the air supply 33*a* includes a wedge shape body having opposed sloping sides 42, 42*a* (not shown), a flat angled top 44, a relatively large flat rectangular rear wall 45 having a round duct receiving flange 46 thereon, and a small front door 47 hingedly attached to a framework (not shown) adjacent the bottom louvered panel 33. Inside the air supply 33*a* a pair of 1" by 24" rails are adjacently fastened to the interior surfaces of the opposing side walls 42, 42*a* to provide for slidably mounting a pair of activated carbon filter panels 30—30 (FIG. 2*a*) therein above the bottom louvered panel 33. This second embodiment air supply is used in connection with a "slimline" unit where space above the false ceiling is at a minimum. Referring to FIGS. 4 and 4*a*, filter boxes used in the "slimline" system, generally shown at 50, and in the regular installation, shown generally at 51, are both rectangular boxes that have a filter cartridge 25 mounted therein for efficient air flow therethrough. As will be shown in more detail below, the separation of the fan unit from the filter box and its placement along the duct work is an important aspect of the present invention.

Filter box 51 is made of a rigid material, such as sheet metal, fiberglass, etc. so as to be air tight when installed. It includes a flat rectangular bottom 52 and top 53, flat opposing sides 54 and 55, each including one or more duct receiving flanges, such as 54*a*, a closed end 56 (not shown) and an open end having an access door 57 thereon. Box 51 would typically be about 20"×12 "×24" or 20"×12"×47" for a dual filter installation as shown.

On the inside of the filter box 51 are opposing pairs of 1"×1"×47" rails 58—58 and 60—60 mounted about 13" apart on the inside of the bottom and top panels 52, 53, respectively, so as to face each other and allow a filter cartridge 25 and activated carbon panel 30 to be mounted therein about one inch apart with air flow being through the duct flange 54*a* and filter cartridge 25 first, to remove particles then through the activated carbon panel 30 to remove odors, then out through a duct flange (not shown) on rear panel 55. Door 57 provides an opening for cleaning and replacing the particle filter cartridge 25 and odor filter panel 30.

Referring to FIG. 4*a*, a combination air return/filter box 50, like air return 51, is made of rigid sheet metal, fiberglass or the like. Air return/filter box 50 includes rectangular opposed side panels 65–66 a top panel 67 having at least one duct flange 68 therein for drawing air up through filter cartridge 25 and through an open mesh bottom screen 70. A back panel 71 and an opposed door 72 is removably connected to side panel 66 by over-center type clamps 72*c*, 72*d*, retained by hooks 66*a–d* (only one shown) on side panel 66 to provide an access door for removing and cleaning filter cartridge 25. Along the interior sides of panels 65–66 adjacent the bottom thereof are mounted an opposed pair of 1"×1"×14" rails 72–73 to provide a mounting for the frame of filter cartridge 25 to be slidably mountable thereon. The bottom mesh panel 70 (not shown) is sized to mount on a false ceiling grid, typically 24"×24", with two filter cartridges 25 in line, but may be doubled in size to 24"×48" with four filter cartridges thereon.

Figure 5:
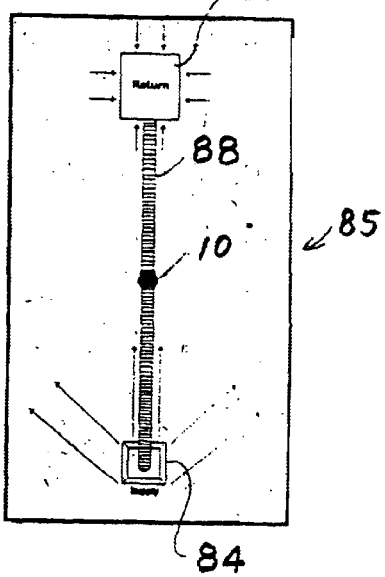
FIG. 5 is a diagrammatic view of a clean air delivery apparatus utilizing a single return, single supply flow pattern.
Figure 6:
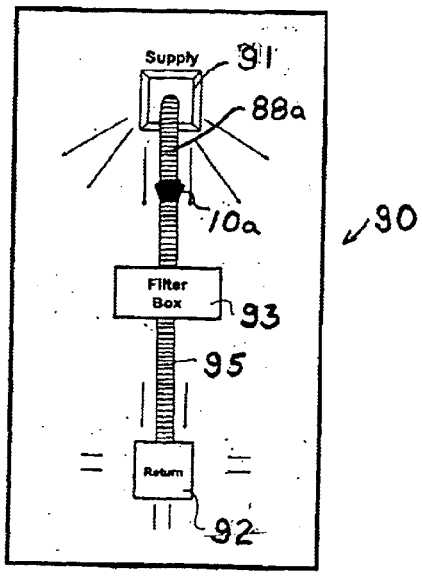
Figure 7:
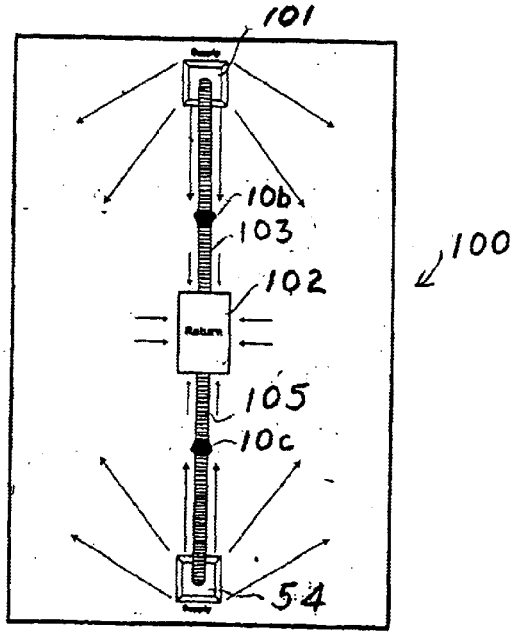
FIG. 7 is a diagrammatic view of a clean air delivery apparatus utilizing a dual supply and single central return/filter.

Referring to FIGS. 5, 6, and 7, various modular clean air filter and delivery apparatus configurations and air flow patterns are shown. In FIG. 5, an inline modular clean air delivery apparatus, constructed in accordance with the present invention, generally indicated at 85, is utilized for cleaning or purifying the air in a rectangular room as shown by the outline. In-line clean air delivery apparatus 85 includes an air supply or diffuser 84. In connection with the air supply 84 shown in FIG. 5, dampers or louvers in the supply are chosen to be directional as shown at 40 in FIG. 3*b* or adjustable as shown at 33 in FIG. 3 to direct air toward the return 87 on the opposing side of the room to obtain a direct flow pattern. These supplies also contain carbon odor filter(s) 30. As mentioned previously, the air return 87 positioned on the opposing side of the room is a combination air return/particle filter box (FIG. 4*a*) that is mounted with the return to be flush with the false ceiling in the room.

Air is then directed upwardly through a grating or mesh screen 70 mounted in the bottom of the return 50 in FIG. 4*a*, through the mini-pleat V-bank cartridge 25 and out the top of the return where an elbow (not shown) joins the return to the flexible ducting 88 that runs between the return and the remote supply 84 that includes an activated carbon panel 30. Mediate the combination return filter 87 and the supply 84 is positioned the fan unit 10 consisting of the single inlet backward curved centrifugal fan 20 (FIG. 1). As indicated previously, the fan housing 11–12 makes up an efficient shroud for the centrifugal fan 20 and provides circular outlet 13 and inlet 14 for mounting the flexible duct work 88 in an air tight relation thereto. The combination of the flexible duct work and the completely shrouded fan unit 10 provides for very efficient cost-effective flow of air from the filter box/return 87 to the supply or diffuser 84.

Also, it should be noted that fan 10 is pumping particle free air from the return/filter box 87 to and through the odor removing activated carbon panel 30.

Referring to FIG. 6, a second configuration of an in-line clean air delivery apparatus, generally indicated at 90, constructed in accordance with the present invention, not only includes a supply 91 positioned at one end of a room and a return 92 positioned at the opposing end of the room, but also includes a separate air tight filter box 93 positioned mediate the supply 91 and the return 92 above any false ceiling in the room. This configuration has been designated a "slimline" unit. In this embodiment 90, the supply includes the flexible round duct work 88*a* extending therefrom and has the fan unit 10*a* positioned mediate the supply and the filter box 93 with an additional flexible duct work positioned between the inlet of the filter box and the return duct work 95 between the inlet of the filter box and the return. In operation, the air flow through the filter box 93 is horizontal and the V-pleat filter cartridges 25 and activated carbon filter cartridge 30 are positioned vertically (as shown in FIG. 4).

In one important aspect of the present invention, it has been found that in the preferred embodiments of the modular clean air delivery apparatus works more efficiently with the minipleat filter cartridges 25 (FIG. 2) positioned on the inlet or low pressure side of the fan unit 10—10*a*. In this configuration, air is drawn through the filter medias 25. As configured, the fan unit 10*a* is also kept cleaner by passing filtered air therethrough. In another important aspect of the present invention, the separation of the fan unit 10*a* from the filter box 93 allows the "slim line" filter box to be made smaller than heretofore known. The "slim line" system may be installed in rooms where the space between a false ceiling and a real ceiling is at a minimum, about 18 inches or less. Prior known filter boxes including a fan unit mounted integrally therein will not fit in such a confined area.

Referring to FIG. 7, a third configuration of clean air delivery apparatus, generally indicated at 100, constructed in accordance with the present invention, is of the type that might be used in a long narrow rectangular room. While the apparatus shown in FIGS. 5 and 6 both feature one circular air flow path from one end of the room to the opposing end of the room, the apparatus 100 shown in FIG. 7 is intended to have two circular paths, each occupying one-half of the room shown in outline. The first circular path runs from the supply 101 across one-half of the room to the central return/filter box 102. After the air is filtered it travels through flexible air duct 103 and the fan unit 10*b* back to the supply 51. A second circular flow of air extends from the opposing supply 104 positioned at an opposing end of a room from supply 101. Clean air travels out of the supply toward the middle of the room to the opposing side of the return/filter box 102 where it moves upwardly through the box and through the filters therein and thereafter through flexible ducting 105 and fan 10*c* back to the supply 104. It should be noted that while the various configurations in-line apparatus shown in FIGS. 5, 6 and 7 disclose straight line air ducting, the flexible air ducting utilized in the present apparatus may be positioned to move around obstructions above the false ceiling of any room in which the clean air delivery apparatus is mounted. The use of the in-line in ducting fans 10*a–c* in connection with the ducting provides for efficient flow of air even when the ducting is curved or bent to flow around obstructions. As noted previously, each fan unit 10*a–c* is positioned downstream of the return/ filter unit 52 (low pressure side) to move filtered air therethrough.

Figure 8:
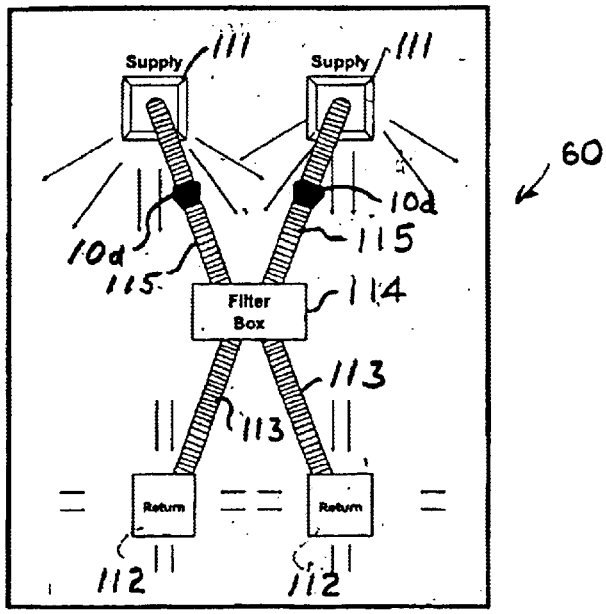
FIG. 8 is a diagrammatic view of a dual supply and dual return clean air delivery system utilizing a horizontal flow filter box therebetween.

Referring to FIG. 8, a second embodiment of a clean air delivery apparatus similar to that utilized in connection with FIG. 6 is shown with increased ducting for providing a single circular flow of air across a wider room than is shown in FIG. 6. In the dual apparatus 60 shown in FIG. 8, a pair of supply diffusers 111, 111 supply air adjacent opposing corners of one end of a room toward the returns 112—112 positioned in the opposing end of the room. When the air enters the return 112—112, it passed through flexible ducting 113—113 into a central enclosed filter box 114 containing both filter cartridges 25 and activated carbon panels 30 mounted vertically in the filter box for horizontal flow therethrough. After flowing through the filters 25–30, the air is passed through flexible ducting 115—115 and fans 10*d*—10*d* back to the supply 111—111. Notice again that the fan units 10*d* are positioned downstream of the filter box 114. Again, the dual filter apparatus 110 shown in FIG. 8 is similar to the apparatus 80 shown in FIG. 6 for use in a narrower or smaller room than that shown at 60. Both of these designs (FIGS. 6 and 8) use the "slimline filter" units.

Figure 9:
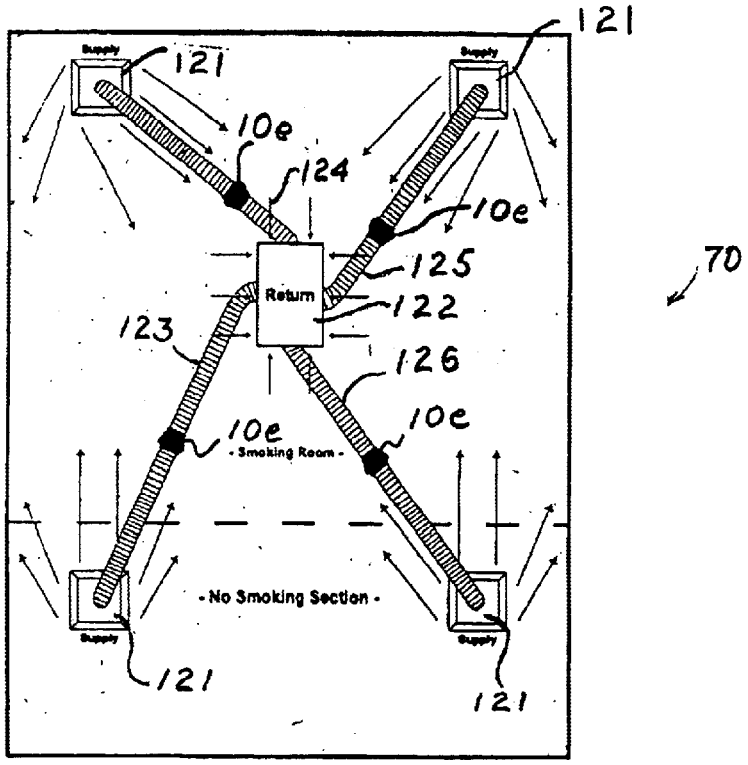
FIG. 9 is a diagrammatic view of a quad supply clean air delivery system utilizing a single return and combination filter box.
Figure 10:
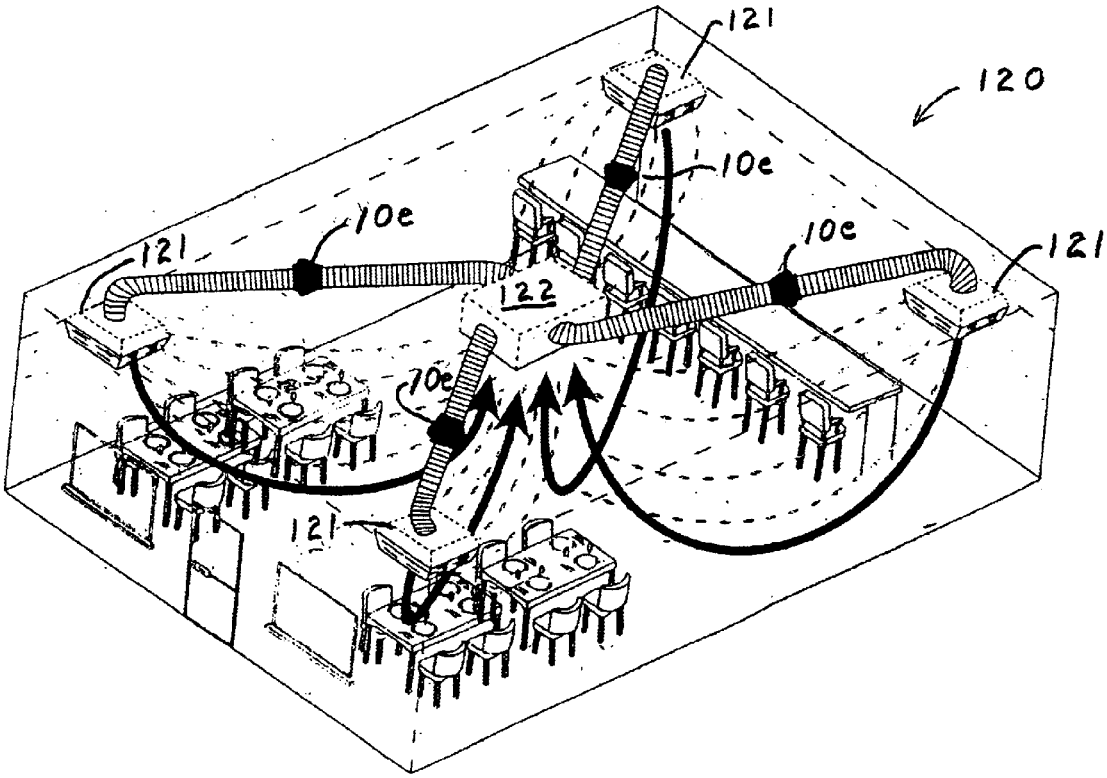
FIG. 10 is a perspective view showing the quad supply clean air delivery system shown in FIG. 9.

Referring to FIGS. 9 and 10, a third embodiment of a clean air delivery apparatus, generally indicated at 120, provides what might be termed a "donut" shaped air flow pattern that includes four supply plenums 121—121, one located adjacent each corner of the room in which the air is to be filtered. The supplies 121—121 push clean filtered air across the activated carbon filter 30 before it is outwardly moved toward a central return 122, which is a combination return and filter box. The filter box return 122 has an intake opening (FIG. 4*a*) and air travels upwardly through the filter box and then at right angles outwardly thereof at four locations around the periphery of the filter box 122 to flexible ducting 123, 124, 125 and 126, each of which is connected via a backward curved centrifugal fan 10*e*10*e*, to one of the external supplies 121—121. Again, each fan unit 10*e* is positioned upstream of the return/filter box 122. As shown most clearly in FIG. 9, the clean air delivery system

120 may be utilized in a room that has both smoking and non-smoking sections, with at least some of the supplies 121—121 positioned in a non-smoking section, the flow of air is from the non-smoking section to the smoking section rather than the reverse as long as the return is positioned over a part of the smoking section of the room. As shown most clearly in FIG. 10, the air flow from each of the supplies 121—121 flows downward and toward the center of the room where the return-filter box 122 is positioned.

A fourth embodiment of the present invention looks identical to the first three embodiments with the exception that the flexible ductwork is replaced with spirally formed rigid ductwork. While the first three embodiments included modules that mounted on false ceiling grid work, a need has developed for an alternative modular clean air delivery apparatus that can be suspended from a ceiling in a restaurant or the like. These modules are suspended from a 20 ceiling by wires similar to those used to suspend a false ceiling grid work itself As shown, in FIGS. 3*b* and 4*a*, eye type flanges or ears, 123—123 in FIG. 3*b* and 124—124 in FIG. 4*a* allow suspension wires 125–126, respectively, to be retained thereon. In restaurants, theatres, etc., the entire ceiling area, including utilities, is usually painted all black to become substantially invisible to a patron. The rigid spiral ductwork maintains the integrity of the complete apparatus in its suspended position.

Thus, a new and improved modular clean air filtering delivery apparatus including state of the art components to remove particles and odors from air in a room and deliver clean air to that room have been shown and described in what may be considered a "keep it simple" system (KISS) that provides superior air quality at low cost. Also, the apparatus provides for ease of installation above false ceilings, a flexible system design that allows for avoiding obstructions and other discontinuities in the false ceiling of a room and provides consistent very efficient performance with maximum air flow management. It may also be suspended from ceilings when used with rigid ductwork.

While four differing embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed is:

1. A clean air filter and delivery apparatus in combination for mounting on a plurality of grid openings of a suspended ceiling of an enclosed building area independent of any heating, ventilating and air conditioning apparatus therein, said apparatus comprising:

air return means mountable on a first grid opening of a suspended ceiling for receiving pre-filtered air flow therethrough, air filter means mounted above any suspended ceiling and in fluid communication with said air return means, blower means mounted above any suspended ceiling and positioned remotely downstream of said air filter means in air tight in-line fluid communication therewith for efficiently pulling air through said air filter means, said blower including, a single inlet backward curved centrifugal fan including a circular inlet and a circular outlet for air tight mating engagement with said flexible duct means, air supply means mountable downstream of said blower means in-line therewith on a second grid opening of a suspended ceiling remote from a first grid opening thereof for delivering filtered air flow therethrough, and flexible duct means positioned above any suspended ceiling between said blower means and said air supply means for delivering air tight fluid flow therebetween.

2. The clean air filter and delivery apparatus as defined in claim 1 wherein said air filter means comprises, a first filter cartridge having a frame including upper and lower surfaces joined by opposing end surfaces and an elongate sheet of pleated filter media extending substantially from one end surface to the opposing end surface with said pleats thereon substantially perpendicularly to and between said upper and lower surfaces for greatly increasing the surface area of said filter media with respect to a cross-sectional area of said frame.

3. The clean air filter and delivery apparatus as defined in claim 2 wherein said air filter means further includes, a second filter cartridge having a frame and activated carbon particles retained thereon.

4. The clean air filter and delivery apparatus as defined in claim 1 wherein said air filter means comprises, a second filter cartridge having a frame and activated carbon particles retained thereon.

5. The clean air filter and delivery apparatus as defined in claim 1 wherein said air return means and said air filter means are combined in a single structure having a mesh grill defining the bottom thereof for vertical flow of air therethrough and through a first filter cartridge defining said air filter means.

6. The clean air filter and delivery apparatus as defined in claim 5 wherein said air filter means further includes a second filter cartridge having a frame and including activated carbon particles retained thereon.

7. The clean air filter and delivery apparatus as defined in claim 1 further including, flexible duct means positioned above any suspended ceiling between said air filter means and said blower means for delivering air tight fluid flow therebetween.

8. The clean air filter and delivery apparatus as defined in claim 1 wherein said air filter means comprises, an air tight hollow box including a circular inlet and a circular outlet having a first filter cartridge therein, said filter cartridge having a frame including upper and lower surfaces and elongate frame members therebetween, and elongate sheet of filter media extending in a plurality of backfolded pleats substantially perpendicularly to and between said upper and lower surfaces between said elongate frame members for increasing the area of filtering media filtering air flowing therethrough.

9. The clean air filter and delivery apparatus as defined in claim 8 further including, a second filter cartridge having a frame and activated carbon particles retained thereon.

10. The clean air filter and delivery apparatus as defined in claim 1 wherein said air filter means includes pleated filter media.

11. A clean air filter and delivery apparatus in combination for mounting on a plurality of grid openings of a suspended ceiling of an enclosed building area independent of any heating, ventilating and air conditioning apparatus therein, said apparatus comprising:

an air return having a rectangular border for mounting on a first grid opening, said air return including a circular outlet for air tight connection with a flexible duct work, an air filter cartridge in fluid communication with said air return, said filter cartridge including a frame including upper and lower surfaces and elongate frame members therebetween, an elongate sheet of filter media extending in a plurality of backfolded pleats substantially perpendicularly to and between said upper and lower surfaces between said elongate frame members for an increased area of filtering media filtering air flowing therethrough, a single inlet backward curved centrifugal fan including a circular inlet and a circular outlet, said fan efficiently drawing air through said return and through said air filter cartridge and drawing filtered air through said centrifugal fan while pushing air through said air delivery supply, a flexible ductwork positioned in air tight relation between said air return circular outlet and said circular inlet of said centrifugal fan, an air delivery supply having a rectangular border for mounting on a second grid opening remote from a first grid opening and having a circular inlet thereon, and a flexible ductwork positioned in air tight relation between said centrifugal fan outlet and said air delivery supply circular inlet.

12. The clean air filter and delivery apparatus as defined in claim 11 further including, a second filter cartridge therein, said second filter cartridge having a frame and activated carbon particles retained thereon, said first and second filter cartridges being positioned adjacent one another aligned for coaxial flow therethrough.

13. The clean air filter and delivery apparatus as defined in claim 11 further including, an air tight hollow box including a circular inlet on one side thereof and a circular outlet on an opposing side thereof for mounting said first filter cartridge therein for horizontal air flow therethrough, said hollow box being mountable above any suspended ceiling, and flexible ductwork positioned in air tight relation between said circular outlet of said air return and said circular inlet of said hollow box, and all said flexible ductwork being mountable above any suspended ceiling.

14. The clean air filter and delivery apparatus as defined in claim 11 wherein, said air return includes a housing for mounting said air filter cartridge thereon, said housing including a mesh grill at the bottom thereof shaped to mount on a grid of a suspended ceiling for intake of pre-filtered air therethrough, and a plurality of circular air outlets in spaced relation around the perimeter of said housing, said apparatus further including, a plurality of said single inlet backward curved centrifugal fans equal to the number of circular air outlets on said housing minus one, and a plurality of flexible ductwork with one such ductwork leading in air-tight relation from each of said circular air outlets on said housing to a circular air inlet on a respective one of said single inlet backward curved centrifugal fans, a plurality of air delivery supplies equal to the number of centrifugal fans minus one, each having a rectangular border for mounting on a grid opening and having a circular inlet thereon, and a second plurality of flexible ductwork with one such ductwork leading in air tight relation between a circular outlet on a respective one of said centrifugal fans to a respective one of said circular inlets on one of said plurality of air delivery supplies.

15. A clean air filter and delivery apparatus in combination for suspended mounting from a ceiling of an enclosed building area independent of any heating, ventilating and air conditioning apparatus therein, said apparatus comprising:

an air return including a circular outlet for air tight connection with rigid spiral duct work, an air filter cartridge in fluid communication with said air return, said filter cartridge including a frame including upper and lower surfaces and elongate frame members therebetween, an elongate sheet of filter media extending in pleats substantially perpendicularly to and between said upper and lower surfaces between said elongate frame members for filtering air flowing therethrough, a single inlet backward curved centrifugal fan including a circular inlet and a circular outlet, said fan efficiently drawing air through said return and through said air filter cartridge and drawing filtered air through said centrifugal fan while pushing air through said air delivery supply, a rigid spiral ductwork positioned in air tight relation between said air return circular outlet and said circular inlet of said centrifugal fan, an air delivery supply having a rectangular border for mounting on a second grid opening remote from a first grid opening and having a circular inlet thereon, and a flexible ductwork positioned in air tight relation between said centrifugal fan outlet and said air delivery supply circular inlet.

16. A clean air filter and delivery apparatus in combination for mounting on a plurality of grid openings of a suspended ceiling of an enclosed building area independent of any heating, ventilating and air conditioning apparatus therein, said apparatus comprising:

air return means mountable on a first grid opening of a suspended ceiling for receiving pre-filtered air flow therethrough, air filter means mounted above any suspended ceiling and in fluid communication with said air return means, blower means mounted above any suspended ceiling and positioned remotely downstream of said air filter means in air tight fluid communication therewith for efficiently pulling air through said air filter means, air supply means mountable remotely downstream of said blower means on a second grid opening of a suspended ceiling also remote from a first grid opening thereof for delivering filtered air flow therethrough, and flexible duct means positioned above any suspended ceiling between said return means and said blower means and between said blower means and said air supply means for delivering air tight fluid flow therebetween, said air return means, said air filter means, said blower means and said air supply means being positioned in-line.

* * * * *